US006513439B2

(12) United States Patent
Brown et al.

(10) Patent No.: US 6,513,439 B2
(45) Date of Patent: Feb. 4, 2003

(54) APPARATUS FOR MARKING A TARGET

(75) Inventors: Donald A. Brown, Vermilion, OH (US); Harvey Lewis Kaufman, Hudson, OH (US)

(73) Assignee: Don-B Corporation, Vermillion, OH (US)

( * ) Notice: Subject to any disclaimer, the term of this patent is extended or adjusted under 35 U.S.C. 154(b) by 0 days.

(21) Appl. No.: 09/999,898

(22) Filed: Oct. 23, 2001

(65) Prior Publication Data

US 2002/0112640 A1 Aug. 22, 2002

Related U.S. Application Data

(60) Provisional application No. 60/273,121, filed on Mar. 1, 2001, and provisional application No. 60/242,494, filed on Oct. 23, 2000.

(51) Int. Cl.[7] ..... F42B 12/40
(52) U.S. Cl. ..... 102/513
(58) Field of Search ..... 102/501–513; 124/57–60; 2/160

(56) References Cited

U.S. PATENT DOCUMENTS

| | | | | | |
|---|---|---|---|---|---|
| 4,226,194 | A | | 10/1980 | Grahn | |
| 4,241,850 | A | | 12/1980 | Speer | |
| 4,308,976 | A | | 1/1982 | Speer et al. | |
| 4,431,118 | A | | 2/1984 | Namdari | |
| 4,449,474 | A | | 5/1984 | Mariol | |
| 4,805,242 | A | * | 2/1989 | Bolton | 2/160 |
| 4,843,014 | A | | 6/1989 | Cukier | |
| 4,867,076 | A | | 9/1989 | Marcone | |
| 5,001,880 | A | | 3/1991 | Smith | |
| 5,018,449 | A | * | 5/1991 | Eidson, II | 102/498 |
| 5,018,450 | A | | 5/1991 | Smith | |
| 5,088,121 | A | * | 2/1992 | Wallace | 2/158 |
| 5,215,227 | A | | 6/1993 | Farner | |
| 5,217,708 | A | * | 6/1993 | Pinkney | 424/43 |
| 5,353,712 | A | | 10/1994 | Olson | |
| 5,393,054 | A | * | 2/1995 | Rouffer | 428/34.1 |
| 5,448,951 | A | * | 9/1995 | Olson | 102/444 |
| 5,529,215 | A | * | 6/1996 | Banks et al. | 222/113 |
| 5,640,945 | A | | 6/1997 | Slonaker et al. | |
| 5,727,538 | A | | 3/1998 | Ellis | |
| 5,823,173 | A | | 10/1998 | Slonaker et al. | |
| 5,949,338 | A | | 9/1999 | Masi et al. | |
| 5,967,133 | A | | 10/1999 | Gardner, Jr. | |
| 6,082,349 | A | * | 7/2000 | Cheng et al. | 124/1 |
| 6,141,801 | A | * | 11/2000 | Helenick | 2/159 |
| 6,223,658 | B1 | * | 5/2001 | Rosa et al. | 102/501 |
| 6,349,711 | B1 | * | 2/2002 | Perry et al. | 124/73 |
| 6,352,032 | B1 | * | 3/2002 | Pinney | 102/367 |
| 6,386,113 | B1 | * | 5/2002 | Pinney | 102/367 |
| 6,393,992 | B1 | * | 5/2002 | Vasel et al. | 102/367 |
| 6,242,489 | B1 | * | 6/2002 | Pinney | 514/562 |

FOREIGN PATENT DOCUMENTS

GB 0786641 A1 * 7/1997 ..... F42B/12/40

OTHER PUBLICATIONS www.rps–paintball.com ( 11 pgs.).
www.awqinc.com (3 pgs.).
www.niehs.nih.gov/external/faq/eggs.htm (1 pg.).

* cited by examiner

*Primary Examiner*—Peter M. Poon
*Assistant Examiner*—Susan L Piascik
(74) *Attorney, Agent, or Firm*—Jones, Day, Reavis & Pogue

(57) ABSTRACT

An apparatus for marking a target. The apparatus includes a soft rupturable capsule and a marking agent contained in the capsule. The capsule is rupturable on impact with the target to release the marking agent from the capsule. The marking agent has a visual staining component and an odorous staining component.

12 Claims, 5 Drawing Sheets

APPARATUS FOR MARKING A TARGET

This Application claims priority from provisional patent application Ser. No. 60/273,121 filed Mar. 1, 2001 and provisional patent application Ser. No. 60/242,494 filed Oct. 23, 2000.

FIELD OF THE INVENTION

A marking system that stains a target with a marking agent.

BACKGROUND

Paintball markers use compressed gas to propel a paintball at a target. The typical rupturable paintball is a spherical gelatin capsule filled with a water-soluble visual marking agent. The paintball ruptures on impact with the target to release the marking agent and to visually mark the target with the marking agent.

SUMMARY

The claimed invention provides an apparatus for marking a target. The apparatus includes a soft rupturable capsule and a marking agent contained in the capsule. The capsule is rupturable on impact with the target to release the marking agent from the capsule. The marking agent has a visual staining component and an odorous staining component.

In accordance with a feature of the claimed invention, an apparatus is provided for marking a target having a target surface. The apparatus includes a baton having first end and a second end spaced from the first end. A handle is at the first end of the baton. A retaining structure is at the second end of the baton. The retaining structure retains an amount of a marking agent and releases a quantity of the marking agent onto the target surface upon striking the target surface. The marking agent has a visual staining component and an odorous staining component.

In accordance to another feature of the invention, the claimed invention further provides an apparatus for marking a target. The apparatus includes a hand covering having a back side and a palm side opposite the back side. A pocket structure is attached to the palm side of the hand covering. The pocket structure contains a marking agent and releases the marking agent upon the contact of the pocket structure with the target. The marking agent havs a visual staining component and an odorous staining component.

BRIEF DESCRIPTION OF DRAWING FIGURES

DESCRIPTION

Figure 1:
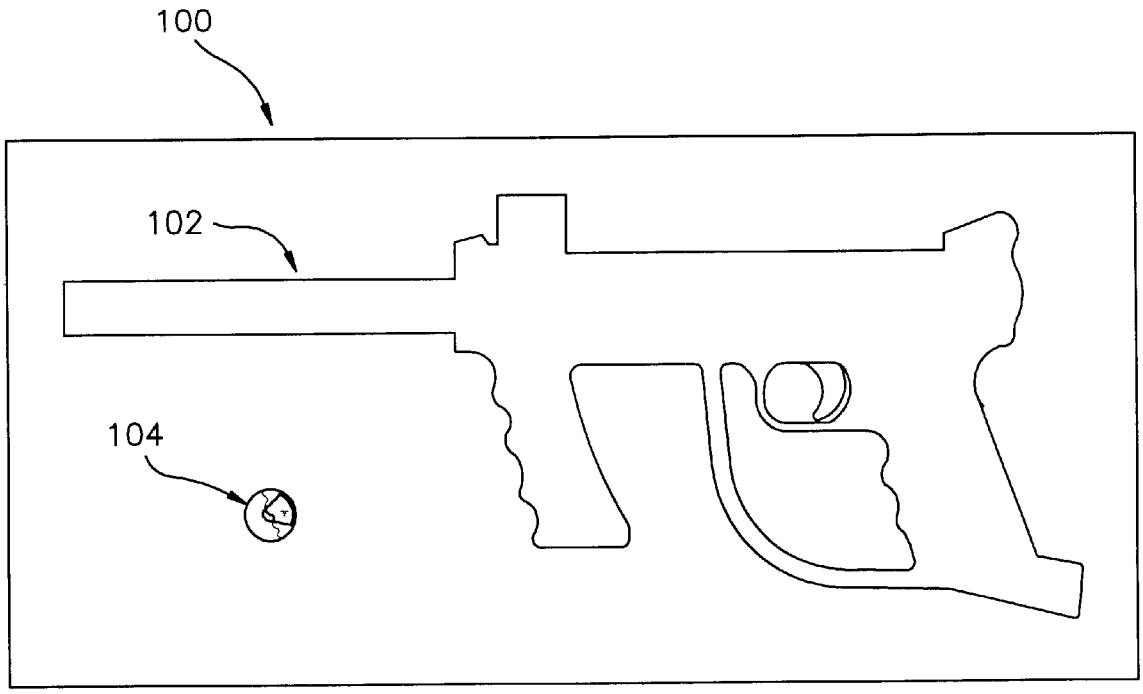
FIG. 1 is a schematic view of a system comprising a first embodiment of the claimed invention.

A system 100 comprising a first embodiment of the invention is shown in FIG. 1. The system 100 is a marking system for the identification of participants in riots.

The system 100 includes a projectile launcher 102, which is preferably a paintball marker. Paintball markers are commercially available, for example, from Tippmann Pneumatics Inc. (Fort Wayne, Ind.). The paintball marker 102 launches a projectile 104 to impinge the projectile 104 against a target area on a target.

The projectile 104 is a rupturable paintball suitable for use with the paintball marker 102. The paintball 104 includes a spherical gelatin shell 106. A liquid marking agent 108 fills the closed shell 106. A mixture of a visual staining component and an odorous staining component together form the marking agent 108.

The visual staining component can cause a visual stain or mark. It is preferably a non-washable, semi-permanent to permanent marker of clothes, uniforms, equipment and/or skin. Dense pigmentation allows the visual staining component to have good visibility but preferably does not appreciably increase the visual staining component viscosity. To increase contrast and visibility, the visual staining component is preferably a bright color, such as yellow, orange, white, and the like, for high visibility. More preferably, the visual staining component is florescent and luminescent.

As mentioned above, the marking agent 108 in this embodiment also includes the odorous staining component. Strong odorants that are resistant to being removed by washing are particularly applicable for use as the odorous staining component. Preferably, the odorous staining component is an emulsion mixture of water ($H_2O$), 1-Methyl Indole (Skatole), a surfactant, and mercaptan. The 1-Methyl Indole and mercaptan are both commercially available from Sigma-Aldrich, Inc. (Milwaukee, Wis.). The surfactant is a surface active agent, i.e., a soap, and is included to emulsify the other ingredients together and to maintain the emulsion.

Table 1 contains the results of testing the travel time over distance of the odorous staining component of this embodiment and also of a control. Note that the control has a lower molecular weight than does the odorous staining component. Both the odorous staining component and the control follow Graham's Law of traveling gases.

$$\text{Graham's Law} \quad \frac{M_1}{M_2} = \frac{t_2}{t_1}$$

Where $M_1$ is the molecular weight of a first material, $M_2$ is the molecular weight of a second material, $t_1$ is the time for the first material to travel a given distance through the atmosphere and $t_2$ is the time for the second material to travel the same distance through the same atmosphere. The molecular weight of the material varies inversely proportionally to its travel speed. That is, the molecular weight of the lesser gas, ammonia in this example, and its speed of reaching a distant target is inversely proportional to the speed of a heavier molecular weight material's speed of travel.

TABLE 1

| Sample | Time to travel 100 linear feet (seconds) |
|---|---|
| Control (Ammonia) | 10.00 |
| odorous staining component | 150.55 |

Table 2 lists the ingredients for the odorous staining component in this embodiment. The odorous staining component is prepared as follows: A mixing tank is charged with the amount of water to be used. The water is agitated in the mixing tank. While agitating the water, the indole powder and the surfactant are added to the water. This mixture is agitated for 30 minutes at room temperature. The mercaptan is added to the mixing tank. The mixture is stirred for 1.5 hours. The resultant composition is then complete and may be packaged into paintballs, for example, or may by stored for use later.

TABLE 2

| Ingredient | Percent by weight |
|---|---|
| Water | 60 |
| Surfactant | 1 |
| Butyl Mercaptan | 2 |
| 1-Methyl Indole | 37 |

The preferred range for the water amount is from about 60 to about 80 percent by weight, the indole amount varies proportionally with the water amount. That is, the indole amount can range from about 37 to about 17 percent. The amount of surfactant and the amount of mercaptan remain relatively constant at about 1 percent and about 2 percent, respectively.

Table 3 shows chemical, physical, and other properties and characteristics of the odorous staining component.

TABLE 3

| Characteristic: | Property: |
|---|---|
| Odor: | Stench |
| Appearance: | Grayish Emulsion |
| Specific Gravity: | 1.01 |
| pH: | 7.0 |
| Boiling point: | >100 degrees Celsius (212 degrees Fahrenheit) |

Other embodiments can include different odorous staining component ingredients, such as other indoles. Other preferred indoles include 2-Methyl indole, 3-Methyl indole, 4-Methyl indole, 5-Methyl indole, 6-Methyl indole, and 1-Butyl indole. Alternative odorous staining component ingredients can also include musk, Hydrogen sulfide, aliphatic diamines such as Putrescine (Tetramethylene diamine) or Cadaverine (Pentamethylene diamine), Dicrotyl sulfide, Butyl mercaptan, and other persistent, strong odorants. The odorous staining component allows marked targets to be identified by smell even if visually stained material has been removed or covered.

During operation, the paintball marker 102 launches the paintball 104 toward the target area. When the paintball 104 strikes the target with sufficient force, the rupturable shell 106 ruptures. That is, because the shell 106 is made of a soft gelatin capsule it ruptures when struck against the target. For example, when the target is a rioter the paintball 104, being softer than the rioter, ruptures upon striking the rioter. When the shell 106 ruptures the marking agent 108 contained inside the shell 106 is released. The marking agent 108 contacts and stains the target and thus marks the target to provide both visual and odorous evidence that the target was struck by the paintball 104.

Figure 3:
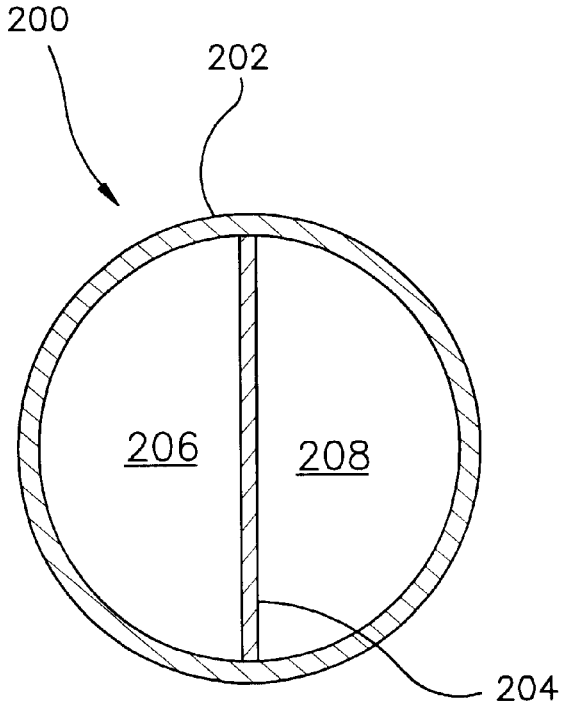
FIG. 3 is a schematic cross sectional view of an apparatus comprising a second embodiment of the claimed invention.

An apparatus 200 comprising a second embodiment of the invention is shown in FIG. 3. The apparatus 200 is a paintball having a shell 202 similar to the shell 106 shown in FIG. 1. The paintball 200 differs from the paintball 104 in that it includes a membranous inner wall structure 204. The wall structure 204 cooperates with the shell 202 to form compartments 206 and 208 that are sealed in the shell 202 and separate from each other. Specifically, the compartments 206 and 208 seal the visual and odorous staining components from a lachrymator component in the shell 202 so that the first compartment 206 contains the visual and odorous staining components and the second compartment 208 contains the lachrymator component.

The lachrymator component is preferably Capsicum (also known as pepper extract) or its chemical equivalents, such as Capsaicin ($C_{18}H_{27}NO_2$). If the target is a rioter, the lachrymator component adds an immediate reactive effect on the rioter upon the rupturing of the shell 202 after striking the target. The visual and odorous staining components can be the same as the visual and odorous staining components described above.

The membrane 204 separating the compartments 206 and 208 is more fragile than the exterior shell 106 of the paintball 200. Upon impingement of the paintball 200 on a target, the inner membrane 202 ruptures. When the membrane 202 ruptures, the components from the compartments 206 and 208 mix together to form a mixture. The shell 202 then ruptures to release the mixture from the shell 202 and mark the target with the mixture.

Still with reference to FIG. 3, and in accordance with another feature of the invention, one of the compartments 206 or 208 may be filled with alternative substances to the lachrymator. For example, the first compartment 206 could contain the visual and odorous staining components, but the second compartment 208 could alternatively contain a substance that effervesces on contact with the visual and odorous staining components rather than contain the lachrymator component. When the paintball 200 impinges on the target, the membrane 204 ruptures before the shell 202 ruptures. When the visual and odorous staining components mix with the effervescent substance, they together form an effervescing liquid that provides an additional propulsive force to the visual and odorous staining components as they are expelled from the rupturing paintball 200.

Further, the paintball 200 may also be pressurized. Specifically, a compressed gas such as carbon dioxide ($CO_2$) can be dissolved into the liquid contents of the paintball 200. When the paintball 200 has been both pressurized and launched it can rupture when it strikes a target. Upon the rupturing of the shell 202, the visual and odorous staining components fizz as the dissolved $CO_2$ off-gases thereby to create an effervescent effect. This effervescent effect can cause the mark/stain left by the visual and odorous staining components to be more pronounced and cover a larger area than it otherwise might cover.

Figure 2:
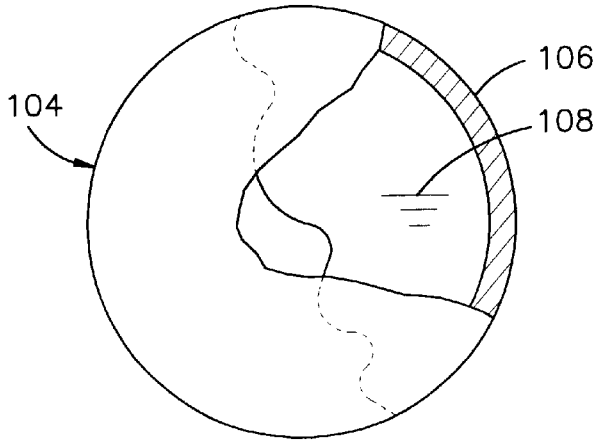
FIG. 2 is an enlarged cut-away view of part of the system shown in FIG. 1.
Figure 4:
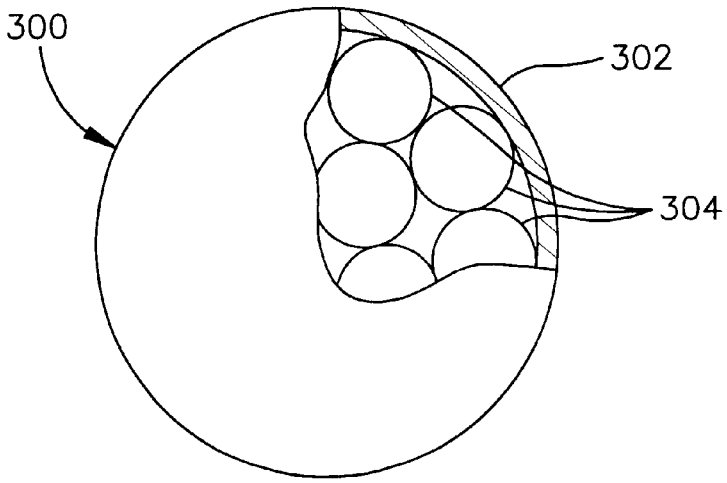
FIG. 4 is a schematic view of an apparatus comprising a third embodiment of the claimed invention with a portion cut away.

With reference to FIG. 4, a third embodiment of the invention comprising a paintball 300 is shown. The paintball 300 includes a rupturable shell 302 like the shell 106 shown in FIG. 2. However, the paintball 302 differs from the paintball 104 in the paintball 302 contains a plurality of prepackaged sub-paintballs 304. Each of the sub-paintballs 304 could be filled with the visual and odorous staining components or with any other combination of the components described above.

During use, the paintball 302 is delivered to the target area by a pneumatic launcher as described above. The paintball 302 ruptures on or near the target so that the sub-paintballs 304 are released from the paintball 302. Upon hitting the target at the target area the sub-paintballs 304 rupture. When the sub-paintballs 304 rupture, the visual and odorous staining components, are released from the shell 302 to mark the target.

Figure 5:
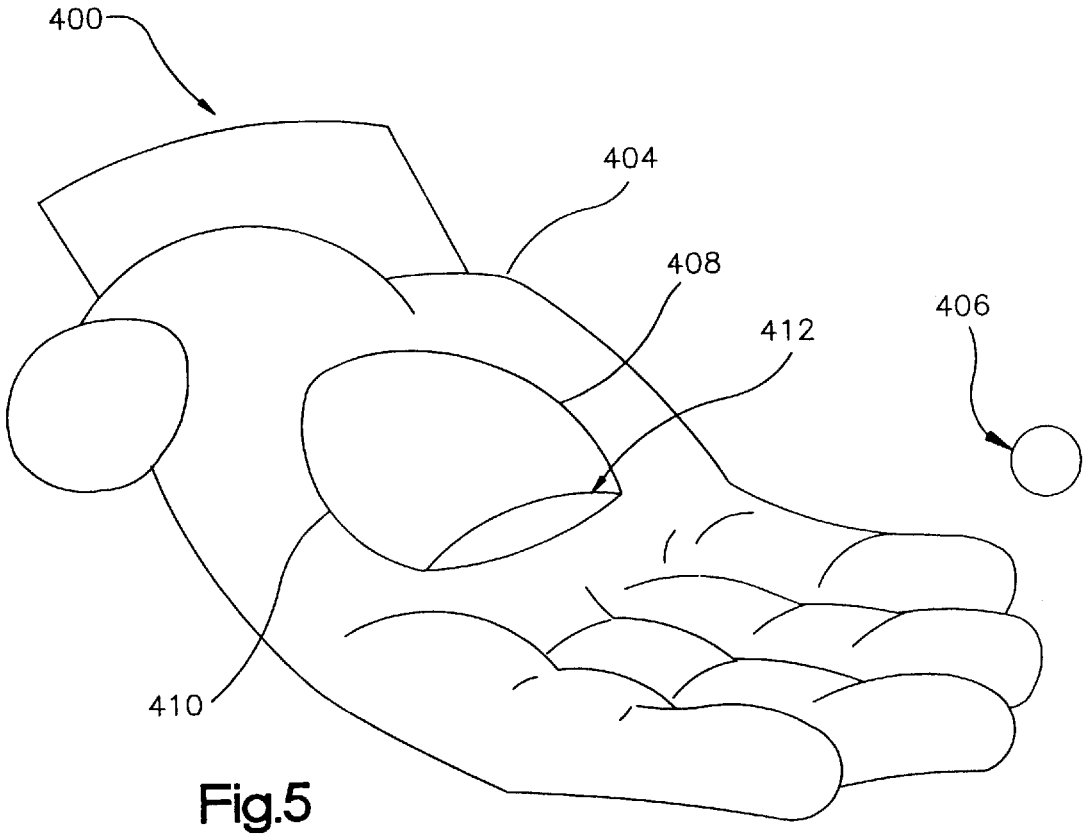
FIG. 5 is a schematic view of an apparatus comprising a fourth embodiment of the claimed invention.

An apparatus 400 comprising a fourth embodiment of the invention is shown in FIG. 5. This embodiment differs from other embodiments in that the apparatus 400 includes a fitted hand covering, which in this embodiment is a glove 404, to deliver a paintball 406 to the target. The paintball 406 is filled with the visual and odorous staining components like the components shown in the paintball 104 of FIG. 2.

The glove 404 has a back side and a palm side and is preferably resistant to penetration by the visual and odorous staining components. Because the glove is resistant it is possible to avoid staining a person delivering the paintball 406 to the target. A butyl rubber or a latex rubber can be used to form the glove 404.

A pocket structure 408 is attached to the palm side of the glove 404. The pocket structure 408 has a peripheral edge 410. The pocket structure 408 is attached to the glove 404 along a portion of the peripheral edge 410. Another portion of the peripheral edge 410 is not attached. Thus, there is an opening 412 into the pocket structure 408 through the not attached portion of the peripheral edge 410. The opening 412 is configured to allow the paintball 406 to be inserted into the pocket structure 408. The pocket structure 408 is configured such that the paintball 406 fits snugly into the pocket structure 408. The snug fit can retain the paintball 406 in the pocket structure 408.

When the apparatus 400 is used, the paintball 406 is inserted through the opening 412 into the pocket structure 408 of the glove 404. The palm side of the glove 404 can be struck against the target with sufficient force to rupture the paintball 406 while it is within the pocket structure 408 to release the visual and odorous staining components from the paintball 406. The visual and odorous staining components flow out of the pocket structure 408 through the opening 412 and onto the target. The glove 404 can be washed, and prepared for reuse by inserting another paintball 406 into the pocket structure 408.

Figure 6:
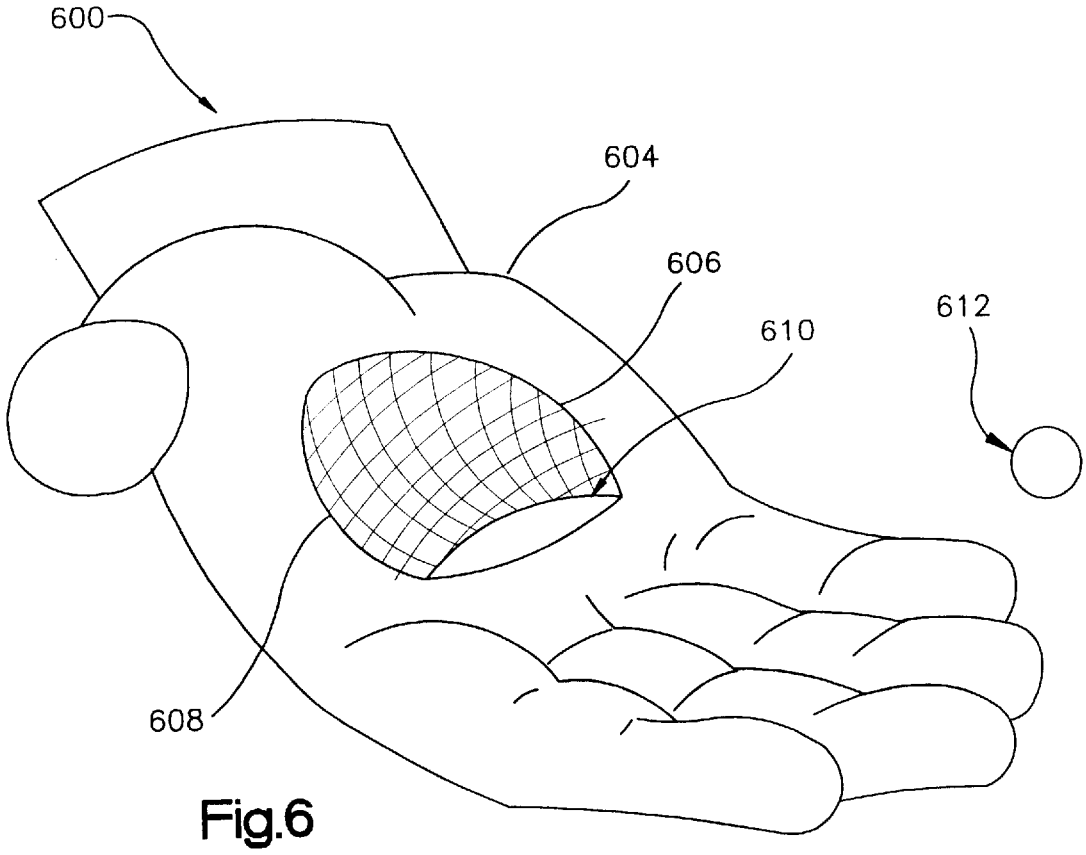
FIG. 6 is a schematic view of an apparatus comprising a fifth embodiment of the claimed invention.

An apparatus 600 comprising a fifth embodiment of the invention is shown in FIG. 6. The apparatus 600 includes a hand covering, which in this embodiment is a glove 604 similar to the glove 404 of the embodiment shown in FIG. 5. The glove 604 has a mesh pocket 606 on the palm side of the glove 604. The mesh pocket 606 has a peripheral edge 608 and is attached to the glove 604 along a portion of the peripheral edge 608. Another portion of the peripheral edge 608 is not attached to the glove 604 to form an opening 610. A rupturable paintball 612 is filled with the visual and odorous staining components like the paintball 104 shown in FIGS. 1 and 2. The paintball 612 releases the visual and odorous staining components when ruptured. The opening 610 in the mesh pocket 606 is sized and shaped to receive the paintball 612.

During use, the apparatus 600 marks the target in a similar manner to the apparatus 400. That is, the mesh pocket 606 is struck against the target with sufficient force to rupture the paintball 612. The visual and odorous staining components from the ruptured paintball 612 flow through the mesh of the mesh pocket 606 to mark the target area.

Figure 7:
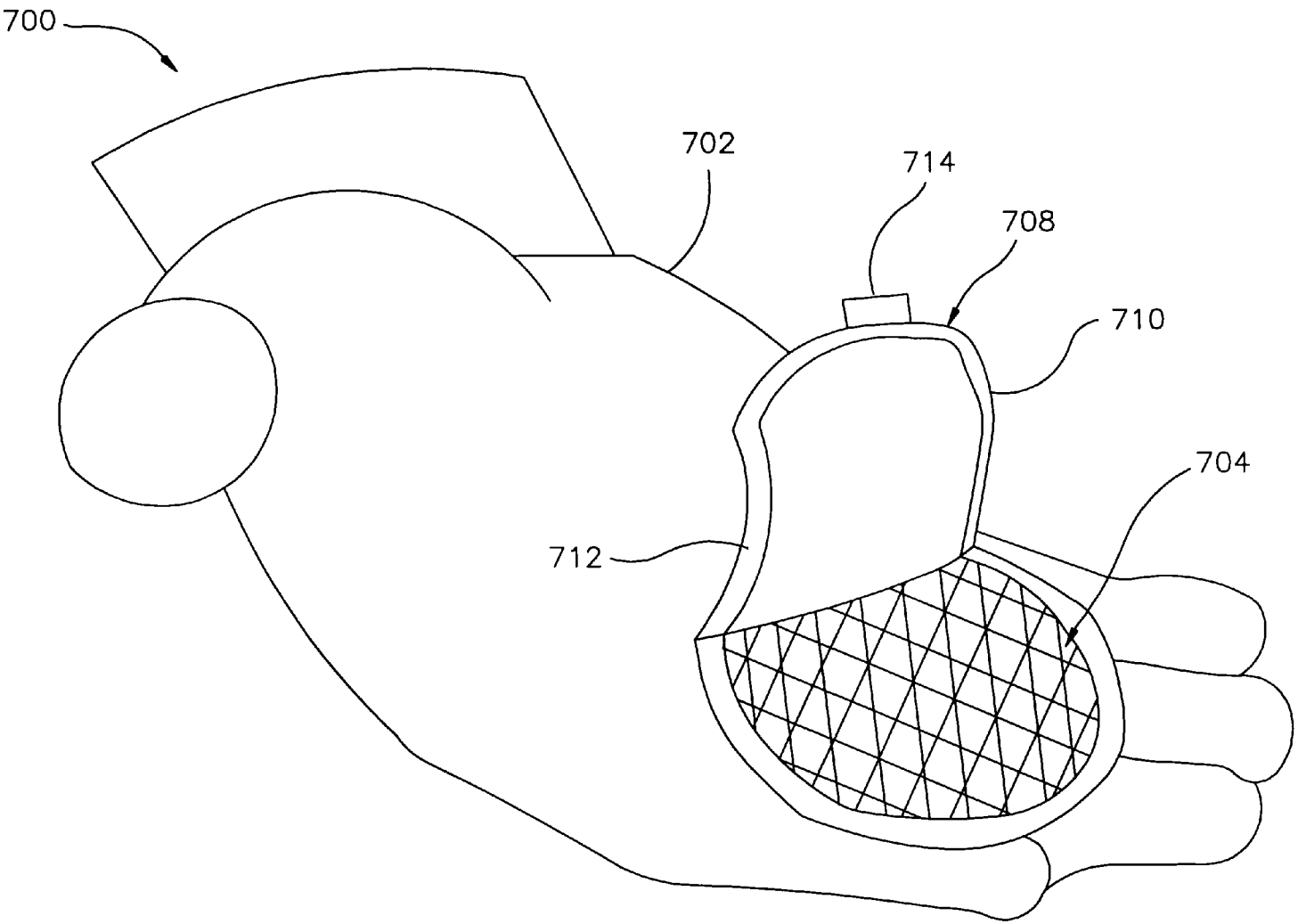
FIG. 7 is a schematic view of an apparatus comprising a sixth embodiment of the claimed invention.

An apparatus 700 comprising a sixth embodiment is shown in FIG. 7. The apparatus 700 is similar to the embodiments shown in FIGS. 5 and 6, in that the apparatus 700 includes a fitted hand cover 702 similar to the gloves 404 and 604. But, instead of including a paintball, the apparatus 700 includes an absorbent pad 704. The pad 704 is impregnated and saturated the visual and odorous staining components.

The pad 704 is attached to the glove 702 along a palm portion of the glove 702. The pad 704 is covered by a peel-off cover 708 resistant to the marking agent 706 liquid. The cover 708 has a peripheral edge 710. Adhesive 712 around the edge 710 forms a seal between the cover 708 and the hand cover 702 contains the marking agent 706 between the cover 708 and the glove 702 until it is desired to remove the cover 708 and exposed the saturated pad 704.

The cover 708 is removed by pulling on a pull-tab 714 on the cover 708. This removal step peels away the peel-off cover 708 and exposes the pad 704. The target can then marked by contacting the target with the pad 704, preferably in a swiping or blotting motion.

Figure 8:
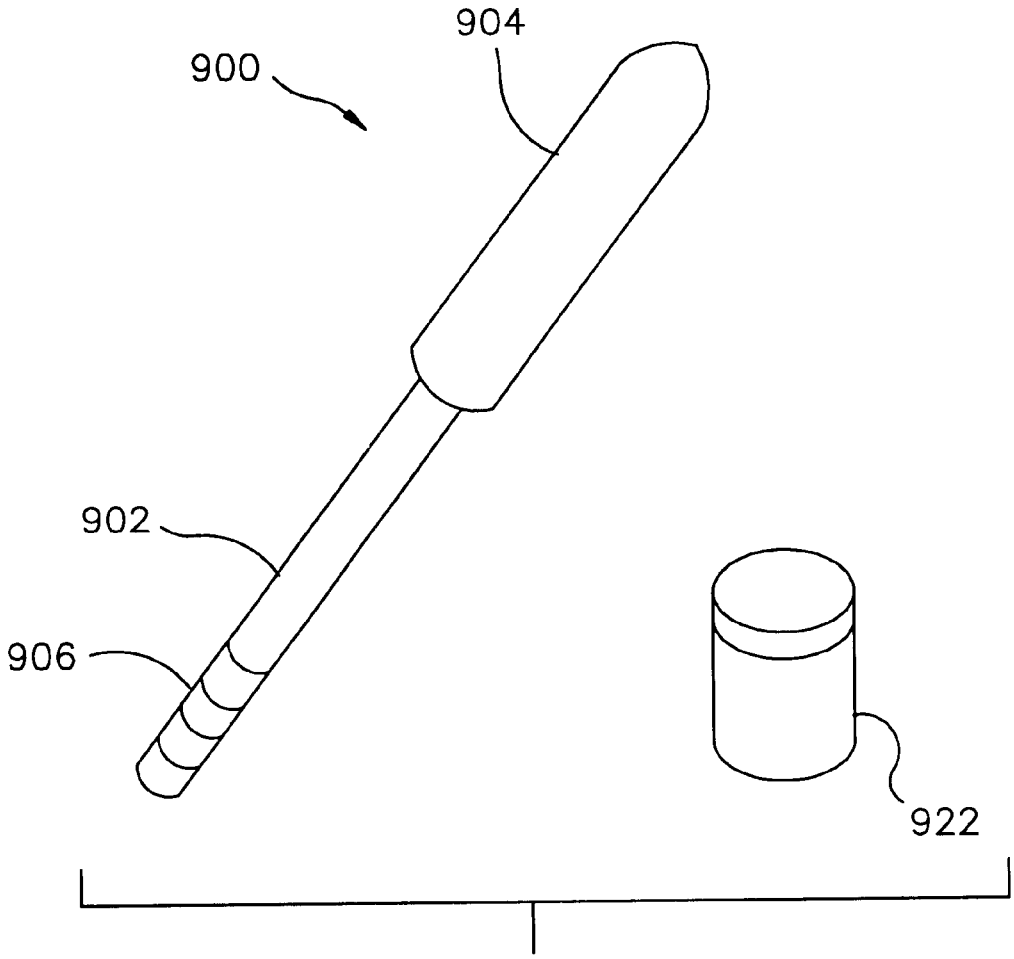
FIG. 8 is a schematic view of a system comprising a seventh embodiment of the claimed invention.

A marking system 900 comprising a seventh embodiment of the invention is shown in FIG. 8. The system 900 includes a baton 902 and an absorbent pad structure 904 at one end of the baton 902. The pad 904 can be, for example, a sponge that surrounds the end of the baton 902. The baton 902 has a handle 906 at a second end opposite the first end of the baton 902. In this embodiment, the pad 904 surrounds the entire second end. The marking system 900 also includes the visual and odorous staining components in a closed, sealed container 922.

During use, the container 922 is opened and the pad 904 is dipped into the visual and odorous staining components in the container 922. The visual and odorous staining components saturate and impregnate the pad 904 while it is in the container 922. The baton 902 can then mark the target by bringing the now-saturated pad 904 into contact with the target.

In alternative embodiments to those described above, a paintball, which is like the paintballs described above, can be filled with dry, rather than wet, components. These dry components include powdered dyes and microcrystalline tearing agents (i.e., lachrymators).

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent elements with insubstantial differences from the literal language of the claims.

What is claimed is:

1. An apparatus for marking a target, comprising:

a hand covering having a back side and a palm side opposite said back side; and a pocket structure attached to said palm side of said hand covering, said pocket structure containing a marking agent and being configured to release said marking agent upon contact of the pocket structure with the target, said marking agent having a visual staining component and an odorous staining component.

2. An apparatus as defined in claim 1, further comprising a capsule that contains said marking agent within said pocket structure.

3. An apparatus as defined in claim 2, wherein said pocket structure is a mesh structure.

4. An apparatus as defined in claim 1, wherein said pocket structure comprises an absorbent pad and a peel-off cover configured to releasably cover said pad, and to seal said pad between said cover and said palm side of said hand covering, said pad being impregnated with said marking agent.

5. An apparatus as defined in claim 1, wherein the marking agent is a liquid or a gel.

6. An apparatus as defined in claim 1, wherein the marking agent is a dry powder.

7. An apparatus as defined in claim 1, wherein the odorous staining component is selected from the group consisting of 1-methyl indole, 2-methyl indole, 3-methyl indole, 4-methyl indole, 5-methyl indole, 6-methyl indole, 1-butyl indole, musk, hydrogen sulfide, aliphatic diamines, tetramethylene diamine, pentamethylene diamine, dicrotyl sulfide, and mixtures thereof.

8. An apparatus as defined in claim 1, wherein the odorous staining component comprises a mixture of water, a surfactant, a mercaptan and an indole.

9. An apparatus as defined in claim 1, wherein the odorous staining component comprises about 60 to about 80 parts by weight water, about 1 part by weight surfactant, about 2 parts by weight butyl mercaptan, and about 17 to about 37 parts by weight 1-methyl indole.

10. An apparatus as defined in claim 1, wherein the visual staining component comprises a permanent liquid dye.

11. An apparatus as defined in claim 1, wherein the marking agent further comprises a lachrymator component.

12. An apparatus as defined in claim 11, wherein the lachrymator component is capsicum or capsaicin.

* * * * *